US006151047A

United States Patent [19]

Desie et al.

[11] Patent Number: 6,151,047

[45] Date of Patent: Nov. 21, 2000

[54] DIRECT ELECTROSTATIC PRINTING APPARATUS HAVING A MAGNETIC BRUSH WITH A CORE ROTATING AT HIGH SPEED

[75] Inventors: Guido Desie, Herent; Dirk Broddin, Edegem, both of Belgium

[73] Assignee: Agfa-Gevaert, Mortsel, Belgium

[21] Appl. No.: 08/906,703

[22] Filed: Aug. 6, 1997

[30] Foreign Application Priority Data

Aug. 14, 1996 [EP] European Pat. Off. ..... 96202286

[51] Int. Cl.[7] ..... B41J 2/04

[52] U.S. Cl. ..... 347/55

[58] Field of Search ..... 347/55, 120, 103, 347/17, 123, 111, 159, 141; 399/267, 270, 276, 277, 282, 275

[56] References Cited

U.S. PATENT DOCUMENTS 4,447,517 5/1984 Yuge et al. .
4,545,670 10/1985 Itoh et al. .
5,325,161 6/1994 Saha et al. .
5,327,169 7/1994 Thompson .

FOREIGN PATENT DOCUMENTS 0625731 5/1994 European Pat. Off. .
0675417 3/1995 European Pat. Off. .
58-81177 5/1983 Japan .
60263962 12/1995 Japan .

*Primary Examiner*—John Barlow
*Assistant Examiner*—Raquel Yvette Gordon
*Attorney, Agent, or Firm*—Baker & Botts, L.L.P.

[57] ABSTRACT

A DEP device is provided that comprises a printhead structure with control electrodes in combination with printing apertures and a magnetic brush assembly delivering a cloud of toner particles in the vicinity of the printing apertures, wherein the toner particles are, together with magnetically attractable carrier particles part of a multi-component developer further and the magnetic brush comprises a magnetic core rotating at a speed equal to or higher than 500 rpm (rotations per minute) and a sleeve rotating at a speed equal to or lower than 10 rpm (rotations per minute).

5 Claims, 1 Drawing Sheet

DIRECT ELECTROSTATIC PRINTING APPARATUS HAVING A MAGNETIC BRUSH WITH A CORE ROTATING AT HIGH SPEED

DESCRIPTION

1. Field of the Invention

This invention relates to an apparatus for use in the process of electrostatic printing and more particularly in Direct Electrostatic Printing (DEP). In DEP, electrostatic printing is performed directly from a toner delivery means on a receiving member substrate by means of an electronically addressable printhead structure.

2. Background of the Invention

In DEP (Direct Electrostatic Printing) the toner or developing material is deposited directly in an imagewise way on a receiving substrate, the latter not bearing any imagewise latent electrostatic image. In the case that the substrate is an intermediate endless flexible belt (e.g. aluminium, polyimide etc.), the imagewise deposited toner must be transferred onto another final substrate. If, however, the toner is deposited directly on the final receiving substrate, a possibility is fulfilled to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

a layer of insulating material, called isolation layer;

a shield electrode consisting of a continuous layer of conductive material on one side of the isolation layer;

a plurality of control electrodes formed by a segmented layer of conductive material on the other side of the isolation layer; and at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode. The printing device as described in the original Pressman patent is very sensitive to changes in distances from the toner application module towards said shield electrode, leading to changes in image density.

By using a printhead structure with different rows of printing apertures this can lead to white-banding which is due to the difference in distance of one row of printing apertures to said toner application module if compared with an other row of printing apertures. Another deficiency is visible in the printing direction if the toner application module is a rotating roller that does not have the shape of a perfect balanced cylinder.

The problem of obtaining a different printing density for different rows of printing apertures has been tackled in the literature. In e.g. U.S. Pat. No. 5,214,451 a printhead structure has been described consisting of different rows of apertures, each having a different shield electrode segment. During printing the voltage applied to the different shield electrode segments corresponding to the different rows of printing apertures is changed, so that these apertures that are located at a larger distance from the toner application module are tuned for a larger electrostatic propulsion field from said toner application module towards said back electrode structure, resulting in enhanced density profiles with less banding. The toner flux can be slightly enhanced for the "low density" rows of printing apertures, said toner flux must be greatly reduced for the "high density" rows of printing apertures. As a result the overall printing speed is reduced if enhanced image quality regarding white banding is preferred.

In U.S. Pat. No. 5,040,004 a moving belt is introduced as toner application module, said moving belt sliding over an accurately positioned shoe that is placed at close distance from said printhead structure. With this design the distance, and as a consequence also the propulsion field, can be finely tuned to be equal for all individual printing apertures. This, however, causes very accurate and expensive means to be used in order to fabricate a toner application module according to said invention. Moreover, sliding contact, is never beneficial for excellent long term stability and reliability.

In DE-A 1 95 34705 the toner application device and printhead structure has been implemented twice for each colour, so that the problem of white banding and of variation of the distance of said toner application module towards said printhead structure can be reduced, but again at the expense of complexity and cost of the printing device.

In CA-A 2,135,705 a toner application device similar to a video cassette is used. A flexible band carrying toner particles is moved in a direction orthogonal to the rows of printing apertures, yielding a constant distance, and propulsion field, for every row of printing apertures. The main drawback of this system, however, is the consumption of toner particles from one side of a row of printing apertures to the other side, making it not possible to print with an equal density profile over the complete width of the receiver material. Moreover a deviation in distance from the surface of said toner carrying roller to said printhead structure leads also to a deviation in printing density in the direction orthogonal to the printing direction.

In EP-A 587 366 the printhead structure is bent over the roller-shaped toner applicator so that for every individual printing aperture the distance towards the toner application module (and thus the propulsion field) is rather constant. The main drawback of this device is again the frictional contact over toner particles that greatly reduces the overall printing quality and long term stability.

In EP-A 736 822 and EP-A 740 224 a DEP device is described in which the frequency of said density banding (in a direction orthogonal to said printing direction) due to the variation of the distance from the toner application module towards said printhead structure is diminished. To achieve this better evenness in printing, it is disclosed in both applications to give the toner bearing surfaces of the toner delivery means rather high rotational speeds. Since the surfaces that bear the toner particles rotate very fast and the distance between said toner bearing surfaces and the printhead structure is low, the particles are exposed to quite large shearing force. This high shearing force can give raise to agglomeration and/or deformation of the toner particles (especially when in the toner particles polymeric toner resins with low (<60° C.) Tg are used. Thus the printing apertures can be clogged by agglomerated or deformed toner particles, leading to images with missing dots and bad image quality.

On the other end, if the frequency of said density variations is changed to a rather low value, then again at a small viewing distance said frequency is less sensitive to the human eye and the image is perceived as a high quality image. Said low frequency, however, is obtained by using a very low rotational speed and in this case the amount of marking particles that can be provided towards said printhead structure is too low to get a high image density.

There is thus still a need for a DEP system yielding reliable and stable images of high density without density fluctuations in the print direction and in a direction orthogonal to said printing direction.

OBJECTS OF THE INVENTION

It is an object of the invention to provide an improved Direct Electrostatic Printing (DEP) device, printing high quality images with a high density resolution and with a high spatial resolution.

It is a further object of the invention to provide a DEP device combining high image quality with good long term stability and reliability.

It is still a further object of the invention to provide a DEP device printing images with high density without density fluctuations in image parts of constant density.

It is another object of the invention to provide a DEP device printing images without density fluctuations at a high printing speed and wherein the clogging of printing apertures by agglomerated and/or deformed toner particles is avoided.

Further objects and advantages of the invention will become clear from the description hereinafter.

The above objects are realized by providing a DEP device comprising:

means (V4, V1) for creating a flow (104) of charged toner particles from a magnetic brush assembly (101), carrying a developer with magnetically attractable carrier particles and non-magnetic toner partcles, to an image receiving substrate (109), a printhead structure (106) with printing apertures (107) and control electrodes **(106*a*)**, interposed in said flow af toner particles, a voltage source (V3) for applying an image-wise adaptable voltage on said control electrodes for image wise modulating said flow of toner particles, characterised in that said magnetic brush assembly has a rotably mounted core and a sleeve rotatably mounted around said core, and is equiped with means for rotating said core at a rotational speed equal to or higher than 500 rotations per minute and with means for rotating said sleeve at a rotational speed equal to or lower than 10 rotations per minute.

DETAILED DESCRIPTION OF THE INVENTION

Figure 1:
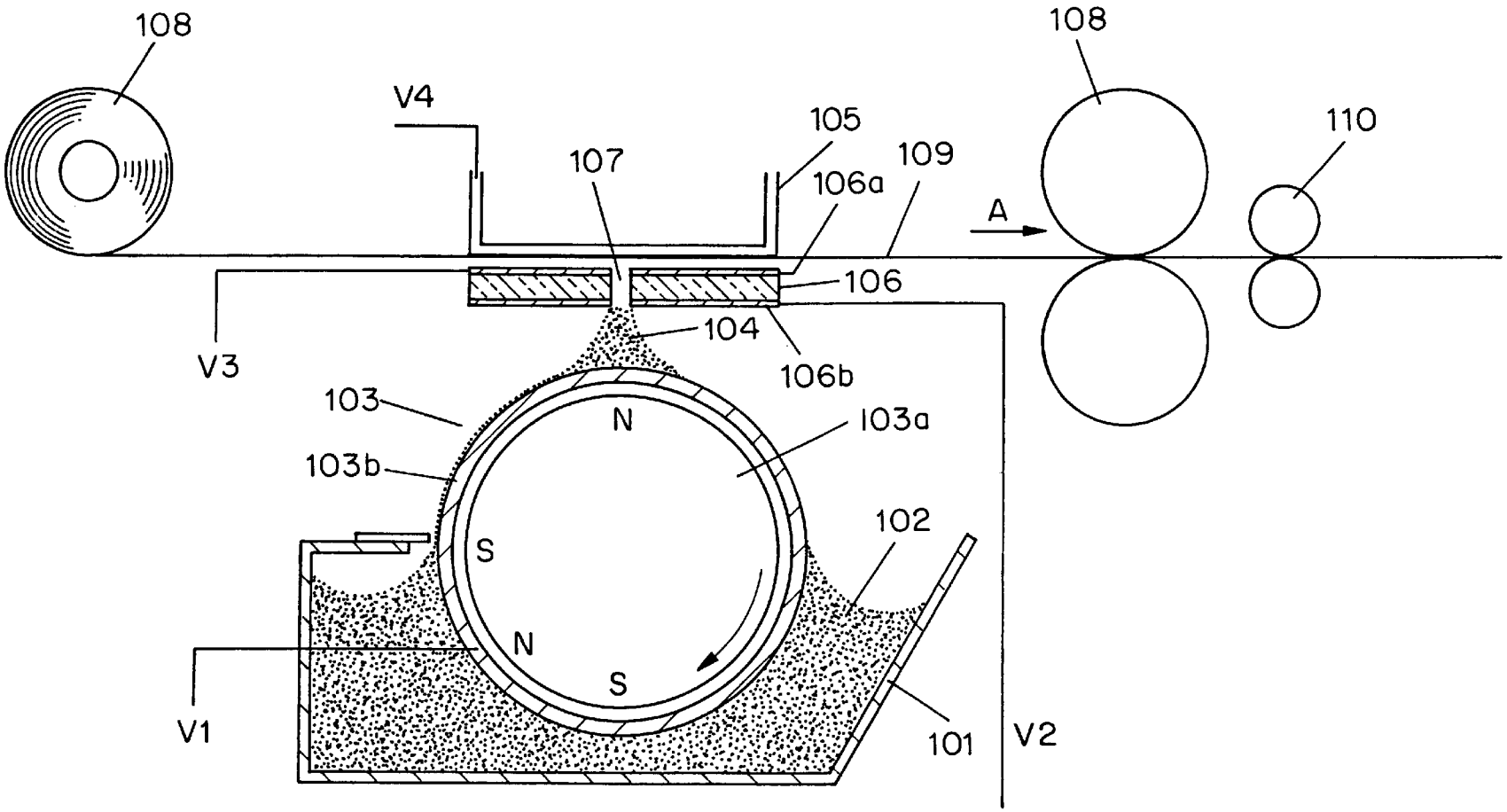
FIG. 1 is a schematic illustration of a possible embodiment of a DEP device according to the present invention.

It was found that by using toner delivery means (hereinafter used to indicate means for delivering toner particles) wherein the toner particles move over a surface by alternating electromagnetic waves, especially magnetic waves, shearing forces exerted on the toner particles are lower than in the cases were the surfaces that bear the toner particles rotate very fast, even when the distance between said toner bearing surfaces and the printhead structure is kept low.

Toner delivery means with internally rotating magnets and a rotating sleeve for use in the DEP printing technique have already been described in JP-A 58/81177 for magnetic mono-component developer. With such a developer, however, it is not possible to obtain colour images with vibrant colours. In EP-A 675 417 a DEP device is disclosed wherein the toner particles are directly extracted from a multi-component developer comprising carrier and toner particles and present on the sleeve of a magnetic brush. Said magnetic brush can be a magnetic brush of the type rotating magnetic core/rotating sleeve. A magnetic brush wherein the magnetic core rotates at 1500 rpm counter-clock wise and the sleeve at 80 rpm clock wise is exemplified to yield a high printed density. It was observed that the evenness of even density patches leaved still room for improvement. It has now be found that the printing evenness of a DEP device extracting toner particles directly from a multi-component developer that is carried on a magnetic brush of the type rotating magnetic core/rotating sleeve could be largely improved when the magnetic core rotated at least at 500 rpm and the sleeve at most at 10 rpm. It was preferred, from the view point of evenness to use a magnetic brush wherein the magnetic core rotated at least at 500 rpm and the sleeve remained stationary. In that case the shearing forces on the toner particles were also minimized and thus the possible clogging of the printing apertures by deformed and/or agglomerated toner particles was also minimized and even avoided. It was preferred from the viewpoint of both maximum optical density that could be reached in the print and the evenness of printing to use a magnetic brush with stationary sleeve and a magnetic core rotating at least at 1000 rpm, preferably at least at 1500 rpm.

In said EP-A 675 417 it has been disclosed that DEP devices, using a multi-component developer on a magnetic brush with rotating magnetic core, yielded the best results when the carrier particles used in the multi-component developer were macroscopic hard magnetic carrier particles, i.e. showing a coercivity higher than 20 kA/m (250 Oersted). It was now found that in a DEP device according to the present invention, using a magnetic brush with a magnetic core rotating at least at 500 rpm and a sleeve that rotated very slowly (at most 10 rpm) or was totally stationary also macroscopic soft magnetic carriers, having a coercivity lower than 20 kA/m (250 Oersted) could be used with good results.

When using a toner delivery means according to the present invention, a cloud of toner particles is formed in the neighbourhood of the printing apertures in the printhead structure. This cloud is densely enough charged with toner particles under the simple influence of the alternating magnetic field created on the surface of the magnetic brush by the rotation of the magnetic core in said brush. Thus no other alternating (electromagnetic) fields are necessary to load the cloud of toner particles with such an amount of toner particles that an acceptable high density at an acceptable high printing speed can be reached. It was however found that the combination of the alternating magnetic field with an alternating electrical field on the toner delivery means provided a DEP device wherein, in comparison with a DEP device with only an alternating magnetic field or only an alternating electric field, the printing speed could be increased for the same maximum optical density. Therefore, in a preferred embodiment of the present invention, an alternating electrical field is applied between the magnetic brush with rotating magnetic core and the printhead structure.

DESCRIPTION OF THE DEP DEVICE

A non limitative example of a device for implementing a DEP method according to the present invention comprises (FIG. 1):

(i) a toner delivery means (101), comprising a container for developer (102) and a magnetic brush assembly (103), this magnetic brush assembly forming a cloud (104) of toner particles from a developer comprsing toner particles and magnetically attractable carrier particles, the magnetic brush has a rotably mounted core (103*a*) and a sleeve (103*b*) rotatably mounted around said core, and is equiped with means (not shown in FIG. 1) for rotating said core at a rotational speed equal to or higher than 500 rotations per minute and with means (not shown in FIG. 1) for rotating said sleeve at a rotational speed equal to or lower than 10 rotations per minute, (ii) a back electrode (105)

(iii) a printhead structure (106), made from a plastic insulating film, coated on both sides with a metallic film. The printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the toner receiving member in said DEP device. The location and/or form of the shield electrode (106*b*) and the control electrode (106*a*) can, in other embodiments of a device for a DEP method, be different from the location shown in FIG. 1.

(iv) conveyer means (108) to convey an image receptive member (109) for said toner between said printhead structure and said back electrode in the direction indicated by arrow A.

(v) means for fixing (110) said toner onto said image receptive member.

The back electrode (105) of this DEP device can also be made to cooperate with the printhead structure, said back electrode being constructed from different styli or wires that are galvanically insulated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

A toner delivery means according to the present invention can also be used in a DEP device operating without a back electrode, but wherein on the substrate to be printed a conductive layer is present and an electrical field, creating a flow of charged toner particles, is applied between said conductive layer and the toner delivery means.

Between said printhead structure (106) and the magnetic brush assembly (103) as well as between the control electrode around the printing apertures (107) and the back electrode (105) behind the toner receiving member (109) as well as on the single electrode surface or between the plural electrode surfaces of said printhead structure (106) different electrical fields are applied. In the specific embodiment of a device, useful for a DEP method, shown in FIG. 1. voltage V1 is applied to the sleeve of the magnetic brush assembly 103, voltage V2 to the shield electrode 106*b*, voltages $V3_0$ up to $V3_n$ for the control electrode (106*a*). The value of V3 is selected, according to the modulation of the image forming signals, between the values $V3_0$ and $V3_n$, on a time-basis or grey-level basis. Voltage V4 is applied to the back electrode behind the toner receiving member. In other embodiments of the present invention multiple voltages $V2_0$ to $V2_n$ and/or $V4_0$ to $V4_n$ can be used.

The printhead structure used in a DEP device according to the resent invention can also be a mesh shaped structure as disclosed in, e.g., EP-A 390 847; it can comprise printing apertures in slit form as disclosed in, e.g., EP-A 780 740. In fact any printhead structure known in the art can be combined with a toner delivery means according to the present invention.

Several types of magnetic carrier particles can be used with a toner delivery means according to this invention. Thus, "soft" magnetic carrier particles can be used in a DEP device according to the present invention. It are preferably so called soft ferrite carrier particles. Such soft ferrite particles exhibit only a small amount of remanent behaviour, characterised in coercivity values ranging from about 4 to 20 kA/m (from 50 to 250 Oe) . An other embodiment of "soft" magnetic carrier particles can be derived from metal based particles. Both types of "soft" particles constitute macroscopic large particles of uniform composition over the whole particle. These particles may be used as such as well as in an resin coated version.

It is also possible to use as "soft" magnetic carrier particles, to be used in a DEP device according to the present invention, composite magnetic particles with a pronounced soft magnetic character. These composite particles comprise essentially the same type of magnetically active materials as the macroscopic large particles, with the exception that the magnetically active material is used in a very fine, quasi microscopic, form, so called pigment form and are bonded together over some binding matrix to form the particles. The advantages of using said particles is twofold: first the magnetic properties of carrier particles comprising microscopic magnetic pigments imbedded in a binder resin can easily be adjusted by changing the formulation of the composite and second carrier particles comprising microscopic magnetic pigments imbedded in a binder resin have a lower specific gravity, giving rise to lower wear of the particles due to lower mutual mechanical impact, thus extending the lifetime of the developer.

As soft magnetic pigments a variety of materials can be used, which comprise magnetic metal pigments such as fine powder, Fe powder, other metals and/or alloys, as well as magnetic oxide pigments both pure iron-based, such as magnetite, mixed iron oxide, etc. and mixed oxide magnetic pigments, commonly referred to as ferrites of the soft type. Ferrites can be represented by the general formula:

$MeO.Fe_2O_3$ wherein Me denotes at least one divalent metal such as $Mn^{2+}$, $Ni^{2+}$, $CO^{2+}$, $Mg^{2+}$, $Ca^{2+}$, $Zn^{2+}$, and $Cd^{2+}$, furtheron doped with monovalent or trivalent ions. As a special case $FeO.FeO_3$, magnetite, can be mentioned. The pigments referred to as soft are characterized by a coercivity of at most 20 kA/m (250 Oe).

It is however possible in the present invention to use also hard magnetic carrier is used as described in e.g. U.S. Pat. No. 4,765,445.

Any kind of two-component toner particles, black, coloured or colourless, can be used in a DEP device according to the present invention. It is preferred to use toner particles as disclosed in U.S. Pat. No. 5,633,110, that is incorporated by reference.

The invention also comprises a method for direct electrostatic printing using a DEP device according to this invention. It incllused thus a method for direct electrostatic printing with reduced banding comprising the steps of:

creating a DC potential difference between an image receiving substrate and a magnetic brush assembly assembly having a rotatably mounted core and a sleeve rotatably mounted around said core;

rotating said core at a rotational speed equal to or higher than 500 rotations per minute and rotating said sleeve at a rotational speed equal to or lower than 10 rotations per minute;

applying a developer with toner particles and magnetically attractable carrier particles on said magnetic brush assembly;

creating a flow of toner particles directly from said magnetic brush assembly to said image receiving substrate;

interposing a printhead structure, having printing apertures and control electrodes around said printing apertures, between said magnetic brush assembly and said substrate;

applying a voltage on said control electrodes for image wise controlling said flow of toner particles;

image wise depositing toner particles on said substrate through said printing apertures and fixing said toner particles to said substrate.

A DEP device according to this invention can be adressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage V3 applied on the control electrode 106*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution, obtained by the small-diameter printing apertures (107), and of the multiple grey level capabilities typical for DEP, opens the way for multilevel halftoning techniques, such as e.g. described in the EP-A 634 862. This enables the DEP device, according to the present invention, to render high quality images.

EXAMPLES

The DEP Device

A printhead structure (106) was made from a polyimide film of 50 μm thickness, double sided coated with a 17.5 μm thick copper film. The printhead structure (106) had four rows of printing apertures. On the back side of the printhead structure, facing the receiving member substrate, a square shaped control electrode (106*a*) was arranged around each aperture. Each of said control electrodes was individually addressable from a high voltage power supply. On the front side of the printhead structure, facing the toner delivery means, a common shield electrode (106*b*) was present. The printing apertures had an aperture diameter of 100 μm. The total width of the square shaped copper control electrodes was 250 μm, their internal aperture width was also 100 μm. The width of the aperture in the common shield electrode was 400 μm. Said printhead structure was fabricated in the following way. First of all the control electrode pattern was etched by conventional copper etching techniques. Then the shield electrode pattern was etched by conventional copper etching techniques. The apertures were made by a step and repeat focused excimer laser making use of the control electrode patterns as focusing aid. After excimer burning the printhead structure was cleaned by a short isotropic plasma etching cleaning. Finally a thin coating of PLASTIK70, (trade name) commercially available from Kontakt Chemie, was applied over the control electrode side of said printhead structure.

The toner delivery means (101) was a magnetic brush, comprising a magnetic core and a non-magnetic sleeve. Various rotational speeds of the magnetic core and of the sleeve of said magnetic brush were used for printing. The values for each example are given in table 1.

The magnetic brush assembly (103) was constituted of the so called magnetic roller, which in this case contained inside the roller assembly a rotating magnetic core, showing 12 magnetic poles of 50 mT (500 Gauss) magnetic field intensity. The magnetic roller contained also a sleeve, fitting around said magnetic core, and giving to the magnetic brush assembly an overall diameter of 32 mm. The sleeve was made of finely roughened stainless steel. A scraper blade was used to force developer to leave the magnetic roller. And on the other side a doctoring blade was used to meter a small amount of developer onto the surface of said magnetic brush assembly. The magnetic brush assembly (103) was connected to an AC power supply with a square wave oscillating field of 600 V at a frequency of 3.0 kHz with 0 V DC-offset.

The Developer

A macroscopic "soft" ferrite carrier consisting of a MgZn-ferrite with average particle size 50 μm, a magnetisation at saturation of 36 $\mu Tm^3/kg$ (29 emu/g) was provided with a 1 μm thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$—was added in a quantity of 0.5% with respect to the binder. It was found that—by mixing with 5% of said ammonium salt—the volume resistivity of the applied binder resin was lowered to $5\times10^{14}$ Ω.cm.

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in the above mentioned EP-A 675 417, giving q=−7.1 fC, q as defined in said application.

The distance l between the front side of the printhead structure (106) and the sleeve of the magnetic brush assembly (103), was set at 450 μm. The distance between the back electrode (105) and the back side of the printhead structure (106) (i.e. control electrodes 106*a*) was set to 500 μm and the paper travelled at 1 cm/sec. To the individual control electrodes an (imagewise) voltage V3 between 0 V and −300 V was applied. The shield electrode was grounded: V2=0 V. The back electrode (105) was connected to a high voltage power supply of +1500 V. To the sleeve of the magnetic brush an AC voltage of 600 V at 3.0 kHz was applied, without DC offset.

Example 1 (E1)

Printing proceeded with a DEP device and a developer described above. The core of the magnetic brush rotated at 1500 rpm counter-clock wise and the sleeve at 3 rpm clock wise.

Examples 2–5 (E2–E5)

A printing configuration as described in example 1 was used, except for the fact that the rotation speed of the sleeve of said magnetic brush and of said magnetic core was changed as indicated in table 1.

Comparative Examples CE1–CE4

For comparative examples CE1 to CE4 the same configuration as described in example 1 was used except for the fact that the rotation speed of said outer sleeve and of said magnetic core was changed as indicated in table 1.

Grey scale images with 16 time-modulated levels were printed with 10 all printhead structures as tabulated in table 1. The image homogeneity in the print direction was visually judged from excellent (1) to bad (5). The results are given in table 1.

TABLE 1

| Sample | Rotational speed of core | Rotational speed of sleeve | Printing quality |
|---|---|---|---|
| E1 | 1500 | 3 | 2 |
| E2 | 1000 | 3 | 2 |
| E3 | 500 | 4 | 3 |
| E4 | 1000 | 0 | 1 |
| E5 | 1500 | 0 | 1 |
| CE1 | 1500 | 80 | 4 |
| CE2 | 100 | 5 | 4 |
| CE3 | 50 | 5 | 5 |
| CE4 | 5 | 100 | 5 |

From table 1 it is clear that the examples according to the present invention can offer an excellent solution to the problem of banding in DEP devices.

It must be clear to those skilled in the art that additional correcting means can be combined with this DEP device according to the present invention. If e.g. the slowly rotating sleeve has not the shape of a perfect cylinder, its surface irregularities can be measured and said distance deviation towards said printhead structure can be gathered in a LUT (look-up table) from which an additional correction can be performed.

We claim:

1. A DEP device comprising:

means for creating a flow of charged toner particles from a magnetic brush assembly, carrying a developer with magnetically attractable carrier particles and non-magnetic toner particles, to an image receiving substrate, a printhead structure with printing apertures and control electrodes, interposed in said flow of toner particles, a voltage source for applying an image-wise adaptable voltage on said control electrodes for image wise modulating said flow of toner particles, wherein said magnetic brush assembly has a core equiped with means for rotating said core at a rotational speed equal to or higher than 500 rotations per minute and a sleeve rotatably mounted around said core and equiped with means for rotating said sleeve at a rotational speed equal to or lower than 10 rotations per minute.

2. A DEP device according to claim 1, wherein said sleeve of said magnetic brush is stationary mounted around said rotatable core.

3. A DEP device according to claim 1 or 2, wherein said magnetic brush is equiped with means for rotating said magnetic core at a speed equal to or higher than 1000 rotations per minute.

4. A DEP device according to claim 1, wherein said carrier particles are macroscopic soft carrier particles showing a coercivity lower than 250 Oersted.

5. A method for direct electrostatic printing comprising the steps of:

creating a DC potential difference between an image receiving substrate and a magnetic brush assembly assembly having a rotatably mounted core and a sleeve rotatably mounted around said core;

rotating said core at a rotational speed equal to or higher than 500 rotations per minute and rotating said sleeve at a rotational speed equal to or lower than 10 rotations per minute;

applying a developer with toner particles and magnetically attractable carrier particles on said magnetic brush assembly;

creating a flow of toner particles directly from said magnetic brush assembly to said image receiving substrate;

interposing a printhead structure, having printing apertures and control electrodes around said printing apertures, between said magnetic brush assembly and said substrate, applying a voltage to said control electrodes for image wise controlling said flow of toner particles;

image wise depositing toner particles on said substrate through said printing apertures and fixing said toner particles to said substrate.

* * * * *

UNITED STATES PATENT AND TRADEMARK OFFICE

CERTIFICATE OF CORRECTION

PATENT NO. : 6,151,047
DATED : November 21, 2000
INVENTOR(S) : Desie et al.

It is certified that error appears in the above-identified patent and that said Letters Patent is hereby corrected as shown below:

Title page,

Item [60], under "Aug. 6, 1997" insert -- Related U.S. Application Data
[60] Provisional Application No. 60/027,445, Sept. 27, 1996 --;

Item [56] References Cited, FOREIGN PATENT DOCUMENTS: "60263962 12/1995 Japan" should read -- 60-263962 12/1985 Japan --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*